United States Patent [19]

Stevens

[11] Patent Number: 4,920,596

[45] Date of Patent: May 1, 1990

[54] VEHICLE WHEEL ELEVATING DEVICE

[76] Inventor: Michael L. Stevens, 1506 Tree Trail Pkwy., Norcross, Ga. 30093

[21] Appl. No.: 318,183

[22] Filed: Mar. 2, 1989

[51] Int. Cl.[5] ..... E02C 3/00

[52] U.S. Cl. ..... 14/69.5; 254/88

[58] Field of Search ..... 14/69.5, 73; 254/88; 248/352; 414/537

[56] References Cited

U.S. PATENT DOCUMENTS

| | | | |
|---|---|---|---|
| 1,879,123 | 9/1932 | Davis | 254/88 |
| 2,272,334 | 2/1942 | Laurent | 254/88 |
| 3,178,156 | 4/1965 | Rigers | 254/88 |
| 3,638,910 | 2/1972 | Nellis et al. | 254/88 |
| 3,752,441 | 8/1973 | Rogers | 254/88 |
| 3,856,264 | 12/1974 | Thumma | 254/88 |
| 3,915,430 | 10/1975 | Chromy et al. | 254/88 |
| 4,165,862 | 8/1979 | Bennett | 254/88 |
| 4,427,179 | 1/1984 | Price | 254/88 |
| 4,836,501 | 6/1989 | Baer | 254/88 |

FOREIGN PATENT DOCUMENTS

| | | | |
|---|---|---|---|
| 986907 | 4/1976 | Canada | 254/88 |

*Primary Examiner*—Stephen J. Novosad
*Assistant Examiner*—TerryLee Melius
*Attorney, Agent, or Firm*—Donald W. Phillion

[57] ABSTRACT

A two level car wheel elevating device for elevating the front wheel (146) of a car having a bumper assembly (117) and comprising, first (100), second (102), third (104), and a fourth (106) top level wheel tread segments joined together to form a continuous wheel ramp surface over which the car wheel (146) can travel from ground level (142) to the fourth top level wheel tread segment (106) with a minimum of discontinuities, a pair of vertically positioned sidewalls (108, 110, and 112) positioned on either side of the wheel ramp surface and firmly secured to the wheel ramp surface to support the weight of the front or back car wheels on the wheel ramp surface, the top perimeters (136) of the sidewalls extending above the wheel ramp surface a substantially constant distance to reduce the chance of said front wheel of the car from rolling off the side of the wheel elevating device. The first segment comprises a first entrance ramp (100) extending from ground level (142) to the second segment (102) a distance G above ground level with a slope $\beta$, with the second segment (102) being level and extending from the top of the first ramp horizontally a distance L at an elevation G above ground level, with the third segment comprising a second ramp segment (104) with a slope $\alpha$, where $\alpha<\beta$ and extending from the level second segment (102) to the fourth top wheel tread level (106) an approximate distance H from ground level, and the fourth segment (106) comprises a second and final substantially horizontal segment which is the highest ramp device level and the level upon which the car wheel comes to rest. A suitable connector such as bolts and nuts are provided to secure the wheel elevating device securely together at two or more substantially vertical places and to disconnect the wheel elevating device for stacking and storing purposes.

20 Claims, 5 Drawing Sheets

VEHICLE WHEEL ELEVATING DEVICE

This invention relates generally to car wheel elevating devices and more particularly to a car wheel elevating device suitable for cars, such as sports cars, having front bumper assemblies which are often positioned several inches lower to ground level than the bumper assemblies of more conventional family cars and in which the distance between the bottom dead center of the front wheels and the front bumper assemblies is several inches greater than the corresponding distance of more conventional family cars.

As suggested above many models of modern sports cars have unusually low slung bumper assemblies which, along with the nose of the car, extend beyond the front wheels of the car several inches more than the bumper assemblies and noses of more conventional family cars. Accordingly, simpler and shorter wheel elevating ramp devices which are suitable for a conventional family car in that they will accommodate the shorter nose of the car from the front wheel and also the higher positioned front bumper assembly but are not suitable for many sports cars in that such conventional wheel elevating devices rise too steeply and the lower slung and longer nose and bumper assembly dimensions of a sports car will impact the wheel elevating devcie before the wheel of the car is elevated to the top level of the wheel elevating device.

There are available today many wheel elevating devices for conventional family cars, for recreational vehicles (RV's) and mobile homes.

Some of the prior art wheel elevating devices designed primarily for cars and recreational vehicles (RV's) are disclosed in U.S. Pat. No. 1,879,123 issued Sep. 27, 1932 to Davis and entitled Portable Repair Stand, U.S. Pat. No. 2,272,334 issued February 10, 1942, to St. Laurent and entitled Compact Vehicle Wheel Raising Device, U.S. Pat. No. 3,178,156 issued Apr. 13, 1965, to Rigers and entitled Mobile Tire Changer Ramp, U.S. Pat. No. 3,638,910 issued Feb. 1, 1972, to Nellis et al, and entitled Car Wheel Support, U.S. Pat. No. 3,752,441, issued Aug. 14, 1978 to Rogers and entitled Vehicle Wheel Elevating and Elevating Device, U.S. Pat. No. 4,165,862 issued Aug. 28, 1979 to Bennett and entitled Leveling Device For Camper Trailers And Like Vehicles, and U.S. Pat. No. 4,427,179 issued January, 1984 to Price and entitled Leveling Apparatus.

Of the above-mentioned prior art U.S. Patents, the St. Laurent patent, the Rigers patent, the Nellis et al patent, the Bennett patent, and the Price patent all show basically a single, substantially linear ramp rising to a top horizontal surface upon which the wheel ultimately comes to rest. All of the structures mentioned above would be unacceptable for elevating the wheel of a low slung, extended nose and bumper assembly of many of the modern sports cars. The nose or bumper assembly of the sports car would impact the rising ramp (and would thereby be damaged) well before the front wheel was elevated to the top level surface of the wheel elevating device, unless the slope of the ramp was extremely gradual. However, in order to make the ramp slope so gradual as to accommodate a sports car would require an unacceptably long ramp which would not only be very heavy but which would make disassembly for storage and storage itself quite difficult, if not impractical. Certainly the portability of such a device would not be practical except for a large vehicle such as a pick-up truck. Storing such a device in the trunk of the average family car would leave little room for luggage, and storage in the typical sports car trunk would leave virtually no room for luggage.

The prior art patent to Rogers is completely unusable for elevating the wheel (or wheels) of a sports car. The series of three levels 10, 12, and 8 separated by very sharp rises 56 and 22 would require so much power that the sports car would likely overshoot the end of the top level 24. Further, the center level 12 of Rogers is neither necessary nor desirable for elevating a sports car wheel. The bumper assembly of a sports car obviously must rise above both the first and second levels 10 and 12 while the car wheel still rests upon ground level when immediately preparatory to climbing the first level 10.

The three levels 10, 12 and 8 of Rogers is obviously meant for elevating a wheel of a camper for leveling the camper, as the Rogers patent specifically states. Reference is made to the Abstract of the Rogers patent as well as to lines 6–9 of column 1, lines 28–36 of column 1, lines 42–42 of column 1, lines 24–32 of column 2, and lines 10–11 of column 4 and in many other instances, in Rogers.

There is a definite need for a wheel elevating device suitable for the low slung, extended nose and bumper assembly of many of the modern sports cars.

A primary object of the present invention is to provide a wheel elevating device which is suitable for a modern sports car having a low slung, long nosed front end.

Another object of the present invention is a relatively easily disassembled and assembled wheel elevating device for most modern sports cars.

Still yet another object of the present invention is a relatively easily disassembled and compactly stackable and storable wheel elevating device for most modern sports cars.

In accordance with one preferred form of the invention there is provided a car wheel elevating device (also referred to herein as a ramp device) for elevating the front wheel of a car having a low profile bumper assembly and comprising, first, second, third, and a fourth top level wheel tread segments joined together to form a continuous wheel ramp surface over which the car wheel can travel from ground level to the fourth top level wheel tread segment with a minimum of discontinuities, a pair of vertically positioned sidewalls positioned on either side of the wheel ramp surface and firmly secured to the wheel ramp surface to support the weight of the front car wheel on the wheel ramp surface, the top perimeters of the sidewalls extending above the wheel ramp surface a substantially constant distance to reduce the chance of said front wheel of the car from rolling off the side of the wheel elevating device. The first segment comprises a first entrance ramp extending from ground level to the second segment a distance G above ground level, with the second segment being level and extending from the top of the first ramp horizontally a distance L at an elevation G above ground level, with the third segment comprising a second ramp segment extending from the level second segment to the fourth top wheel tread level an approximate distance H from ground level, and with the fourth segment comprises a substantially horizontal segment which is the highest ramp device level and the level upon which the car wheel comes to rest. A suitable connecting means such as bolts and nuts is provided to secure the wheel elevating device securely together at two or more substantially vertical places and to disconnect the wheel elevating device for stacking and storing purposes.

The above mentioned and other objects and features of the invention will be more fully understood from the following detailed description thereof when read in the light of the drawings in which.

Figure 1:
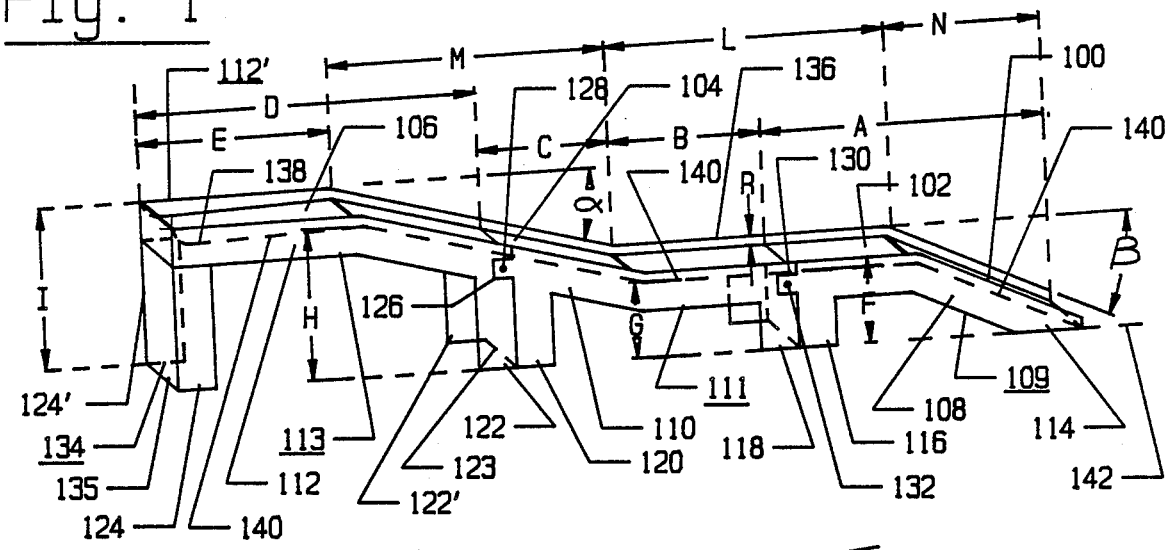
FIG. 1 shows a perspective view of one form of the invention.

In the perspective view of the form of the invention illustrated in FIG. 1 there is shown a continuous wheel tread surface which extends from ground level 142, up the entrance ramp surface 100, along the substantially horizontal surface 102, and finally up the ramp surface 104, to the top level surface 106 which is generally horizontal in shape but with a slight concavity formed therein that substantially reduces the chance of the car wheel (tire) from accidentally rolling thereoff.

The wheel tread surfaces 100, 102, 104, and 106 are secured to, and supported on both sides thereof, by vertically positioned sidewall sections 108, 110, and 112, each of which is a formed extension of wheel tread surfaces 100, 102, 104 and 106.

More specifically, side rail 108 is supported on one side by legs 114 and 116, side rail 110 is supported on one side by legs 118 and 120, and side rail 112 is supported on one side by legs 122 and 124. It is to be specifically noted that leg 114 is shown as an integral part of side rail 108. Legs 116, 118 and 120 are shown as integral parts of vertically positioned plates in the same manner as leg 122 is shown as an integral part of vertical plate 123. Section 109 is secured to section 111 and the section 111 is secured to section 113 by bolts 132 and 128, respectively, which extend, respectively, through tab-like extensions 130 and 126 of rails 108 and 110, and then through holes in rails 110 and 112 and finally through aligned holes in rails and tab-like extensions on the far side of the wheel elevating device of FIG. 1 which are aligned with and correspond positionally with the holes 132 and 128 and the tabs 130 and 126 on the visible side of the structure of FIG. 1.

It is to be specifically noted that the leg 124 of FIG. 1 is a part of a vertical supporting section 134 which, in addition to leg 124, comprises a full vertically positioned back section 135 as well as another corresponding vertically positioned leg section 124' on the back side of the ramp device of FIG. 1. Also, on the back side of the wheel ramp device of FIG. 1 are exact mirror duplicates (not shown) of the rails 108, 110, 112, and the legs 114, 116, 118, 120, and 122. For example, leg 122' shown on the back side of the ramp device of FIG. 1 is the mirror image 122' of leg 122.

The legs 124 and 124' of unit element 134 of FIG. 1 support the left hand ends of the rail 112 and its mirror image rail 112', as by welding or bending over as an integral part thereof, for example, while the back vertical surface 135 of unit element 134 is secured to and supports the extreme left end of the top wheel supporting surface 106 of the ramp device of FIG. 1. It is to be understood that each of the legs support one end of one of the rails 108, 110, and 112 and the corresponding rails on the other side of the car wheel ramp device of FIG. 1, as by welding or bending over an an integral part thereof, for example, which in turn support the wheel tread surfaces 100, 102, 104, and 106 of the ramp device.

As indicated generally above the structure shown in FIG. 1 has corresponding mirror image pairs of legs, such as legs 122 and 122' which are formed as a part of a vertically positioned plate such as plate 123 which is positioned adjacent a similar plate which forms leg 120 with its mirror image leg (not shown) on the back side of the ramp device of FIG. 1. Similar vertically positioned plates form legs 118 and 116 and their mirror image counterpart legs.

The vertically positioned plates, such as plate 123, which form as a part thereof, the mirror image pairs of legs and are also each secured, as by being integral therewith or by welding, for example, to the ends of the section it supports. Thus, plate 123 is secured to the right hand end of the tread surface 106 of section 113 and supports such right hand end of tread surface 106 securely above ground level 142 a predetermined distance H aided by the support provided by the mirror image pair of legs 122 and 122'.

Each of the rails 108, 110, and 112 are formed to extend above the wheel surfaces 100, 102, 104, and 106 to provide a lip equal to the distance F–G, which is preferably about $\frac{1}{2}''$ to $\frac{3}{4}''$.

Typical distances indicated by the upper case letters A, B, C, D, E, F, G, H, I, K, L, M, and N are as follows:

| | |
|---|---|
| A | 15.0 inches |
| B | 8.0 inches |
| C | 7.0 inches |
| D | 18.0 inches |
| E | 16.0 inches |

-continued

| | |
|---|---|
| F | 4.5 inches |
| G | 4.0 inches |
| H | 8.0 inches |
| I | 8.5 inches |
| K | 4.0 inches |
| L | 14.4 inches |
| M | 15.0 inches |
| N | 8.6 inches |

$R=\sim 0.5''T=I+\sim 4''\cong(H+R+\sim 4'-')Y<(N+L+C)>(L+N)$

The angles $\alpha$ and $\beta$ of ramp wheel surfaces are typically 15° and 25°, respectively, with the ramp angle $\alpha$ and the distance H-G determining the distance E, where $E=D+C-(4 \text{ arctan } 15°)=16''$.

Other sets of dimensions will no doubt be more suitable for certain sports cars and almost certainly for sports cars of the future, and possibly for many family type cars.

Referring now to FIGS. 2, 3, 4, and 5 there is shown the progressive elevation of the front wheel of a sports car as it progresses along the ramp device. The car outlines shown in solid lines represent the situation where only one or both of the front wheels of the car are being raised whereas the car outlines shown by dashed lines represent the situation where both the front wheel and the rear wheel (on the same side of the car, or all four wheels of the car) are being raised simultaneously.

It is to be noted that in all of the figures described herein that corresponding elements in different figures are represented by the same reference character, or a prime thereof.

Figure 2:
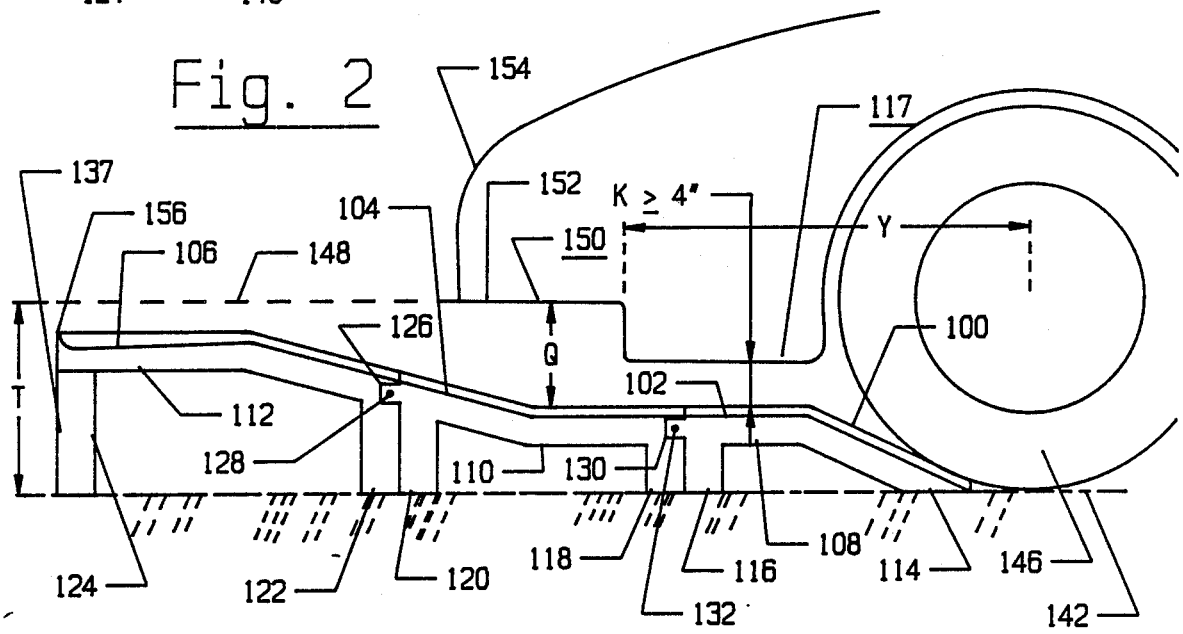
FIG. 2 shows a side view of the invention with the wheel of a sports car about to ascend the entrance ramp of the ramp device.

Referring now specifically to FIG. 2 the car is shown with all four wheels resting on ground level but with the front wheel 146 just ready to mount the entrance ramp surface 100. It will be assumed, for purposes of discussion, that only one front wheel 146 is being elevated so that the car outline is represented by the solid lines.

In FIG. 2 the dashed horizontal line 148 shows that the bottom 152 of the extended nose 154 of the car is above the highest point 156 of the ramp device whens the car wheels are resting on ground level. If the extended nose of the car is in front of (i.e. to the right of) the highest point 156 of the ramp device in FIG. 2 when the car wheels are resting on the ground) then the extended nose of the car can be horizontally flush with, or even below the highest point 156 of the ramp device.

Figure 3:
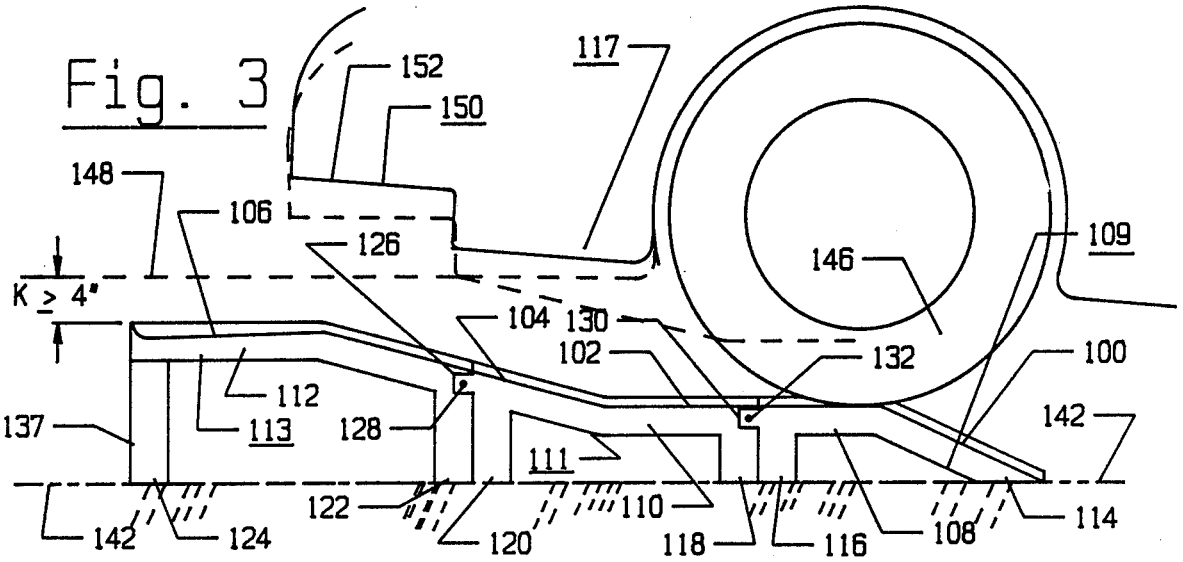
FIG. 3 shows another side view of the invention with the wheel of the automobile having ascended to the top of the entrance ramp and about to move forward on a horizontal tire tread surface portion of the ramp device.

In FIG. 3 the front wheel 146 is shown as having mounted to the horizontal wheel surface level 102 just at the top of the entrance ramp surface 100. It is apparent from FIG. 3 that the nose 154 of the car is well above all parts of the ramp device when only the front wheel is being elevated (see the solid outline 150 of the car), and is sufficiently above all parts of the entire ramp device a distance K where $K \geqq 4''$ when both the front and rear wheels on the same side of the car are being elevated simultaneously.

Figure 4:
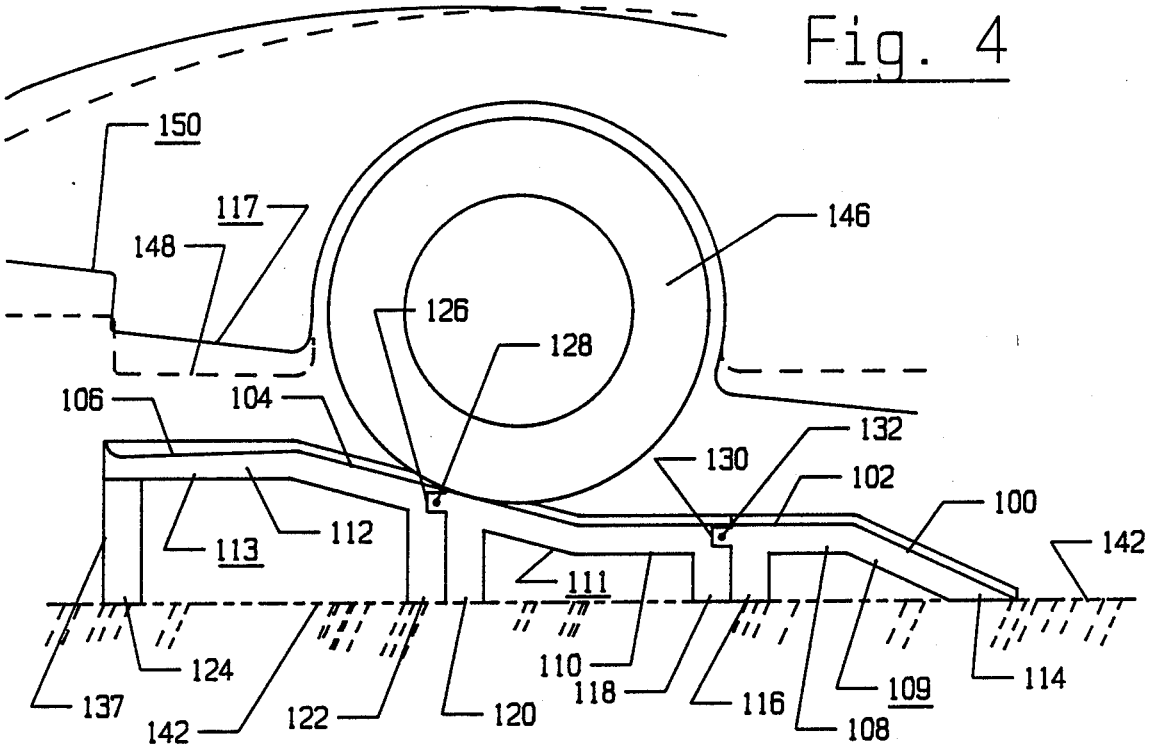
FIG. 4 is yet another side view of the ramp device with the wheel of the car having advanced along the wheel tread surface of the ramp device to the point where it is about to ascend a second ramp of the ramp device to the topmost elevated surface of the ramp device.

FIG. 4 shows position of the front wheel 146 of the car after it has rolled to the length of the horizontal wheel tread surface 102 and is about to begin the climb up the ramp wheel tread surface 104 towards the top elevated surface 106 of the ramp device.

In FIG. 4, as in FIG. 3, the entire nose of the car and also the bumper assembly 117 is shown elevated well above all parts of the ramp device and consequently no part of the car nose 154 or the bumper assembly 117 will have impacted against the ramp device at any point as the car wheel rolled along the entire length of the horizontal wheel tread surface 102 of the ramp device.

Figure 5:
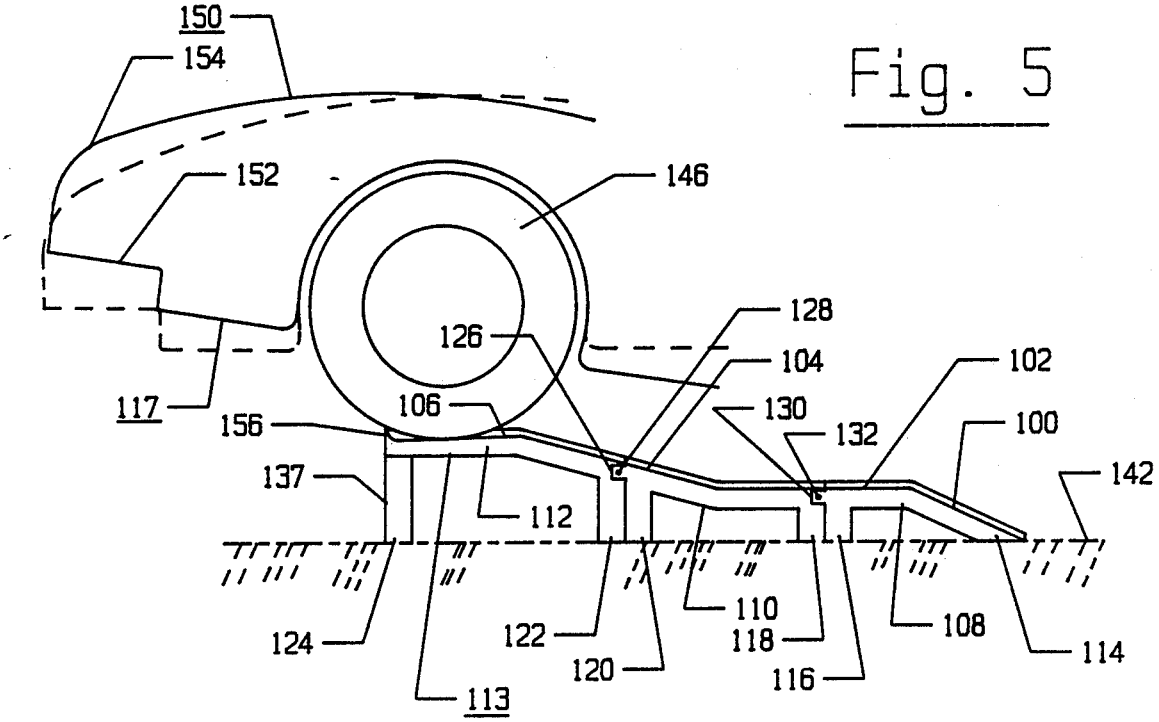
FIG. 5 shows a side view of the ramp device with the weel of the car having climbed the second ramp wheel surface and resting on the topmost elevated surface of the ramp device.

FIG. 5 the front wheel 146 of the car is shown fully elevated to the top wheel tread surface 106 of the ramp device after climbning the ramp wheel tread surface 104. The concave contour of the top surface 106 and the wheel clock device 156 will effectively prevent the car wheel 146 from either overshooting the top surface 106, or, once resting upon such top surface 106, will prevent the front wheel 146 from accidentally rolling off such top surface 106.

Once a wheel, or wheels, are positioned on the topmost horizontal surface 106 the sections 109 and 111 can be removed to provide easier working access to the underside of the car.

Figure 6:
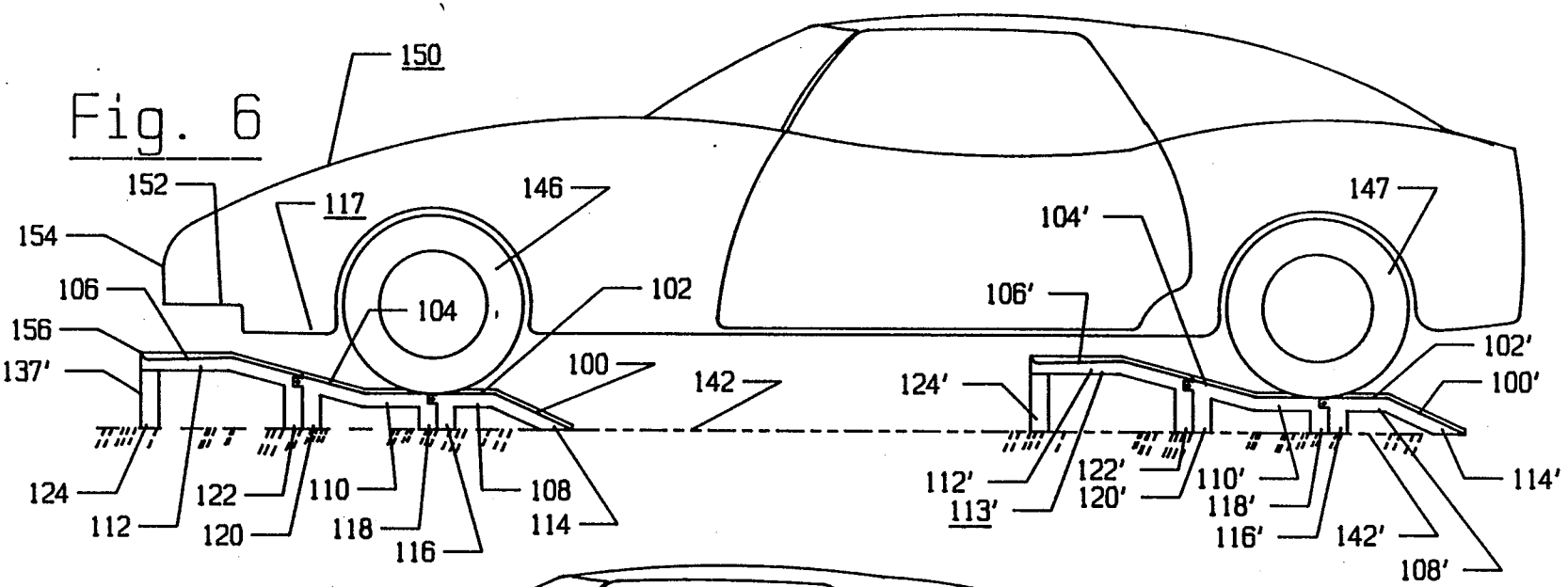
FIG. 6 shows the use of the ramp devices wherein both the front and rear wheels of one side of the automobile are being elevated, and more specifically shows the position of the automobile on the ramp device after both the front and rear wheels have climbed the entrance ramp of the wheel surface and are resting on the horizontal surface at the beginning of such horizontal surface.
Figure 7:
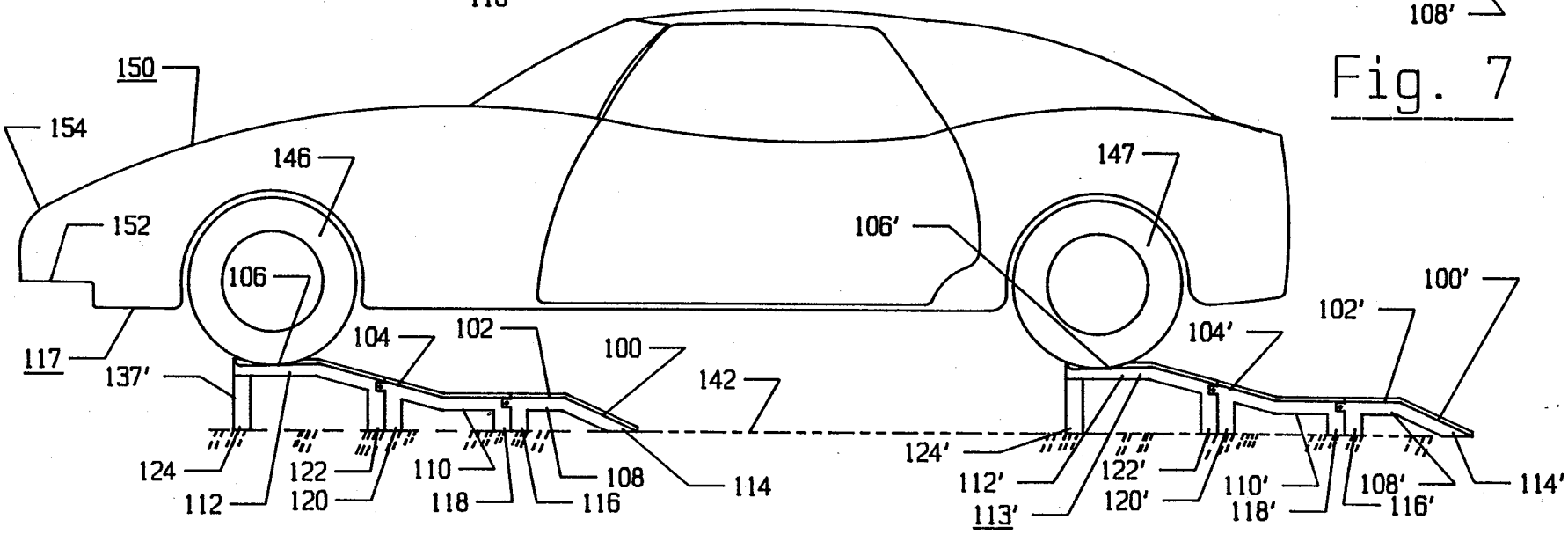
FIG. 7 shows the position of the automobile with both the front and the rear wheels resting on the topmost surfaces of a pair of wheel elevating ramp device.

It is to be specifically noted that in FIGS. 2 through 5, and also in FIGS. 6 and 7 the lips or extensions 138 of the sidewalls of the ramp device over the wheel tread surface 140 are not specifically shown, for purposes of ease of discussion. It is to be understood, however, that they are, in fact, a part of the ramp device and should be considered by the reader as being a part of the ramp devices of FIGS. 2–7.

Also, it is to be noted that in FIGS. 2–7 the dashed line representation of the car shows the position of the car if a ramp device were also employed to elevate the rear wheel of the car as well as the front wheel, as shown in FIGS. 6 and 7.

Referring now specifically to FIGS. 6 and 7 there is shown the situation where both the front wheel and the rear wheel of the car are being elevated simultaneously. It should be noted that before the car begins to mount the entrance ramps 100 and 100' of the front and rear wheel ramp devices the third (highest) section 106' of the rear wheel ramp device is not in palce in the auto ramp devcie since such highest section obviously could not be pushed under the bottom of the car until the rear wheel is elevated onto the horizontal wheel tread surface 102, as shown in FIG. 6. It is at this time that the highest section 113 can be inserted under the side of the car and attached to section 111 by bolt 128.

Both the front wheel 146 and the rear wheel 147 can then be rolled up ramps 104 and 104', respectively, and onto the highest levels 106 and 106', respectively, of the front and rear ramp devices, as shown in FIG. 7.

Figure 8:
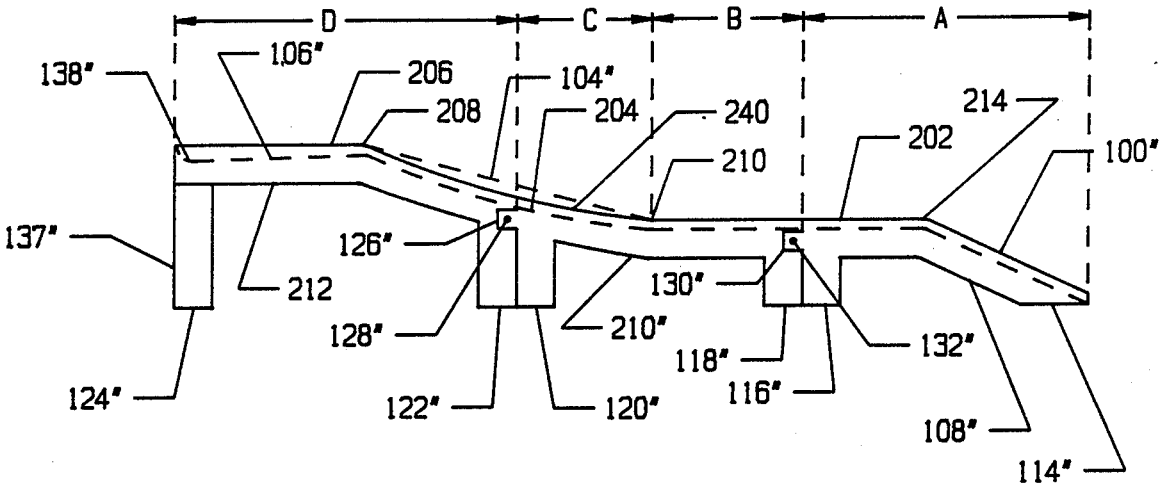
FIG. 8 shows another form of the invention with the wheel tread surface of the ramp device being curvalinear along a part of a wheel surface tread path to facilitate the elevation of the wheel to the topmost elevated surface.

Referring now to FIG. 8 there is shown an alternative form of the invention shown in FIG. 1. The major difference between the structures of FIG. 1 and FIG. 8 is in that portion of the contour of the wheel tread surface 204 (and the top 240 of the sidewalls) of FIG. 8 lying between points 210 and 208 of the wheel ramp device of FIG. 8, as compared with the contour of the comparable wheel tread surface of FIG. 1. More specifically, the wheel tread portion 204 between points 210 and 208 of FIG. 8 defines a generally concave curved plane which meets the horizontal wheel tread surface 202 of FIG. 8 in a smooth, continuous manner at point 210 without any discontinuity in the wheel tread surface.

Thus, the path of the wheel from point 214 at the top of entrance ramp 100'' to the top of curved wheel tread ramp 204 is somewhat easier for the car wheel to traverse than the corresponding wheel tread surface of the ramp device of FIG. 1. The dashed line 104'' of FIG. 8 corresponds to the wheel tread surface 104 of FIG. 1, and can be seen to have a small discontinuity at point 210, which, in most applications is negligible, but which can be of significance when the ramp device is employed with certain cars of unusual front end weight or shape. With the continuous, curved wheel tread path of FIG. 8 the left hand portion of the wheel tread path segment 204 in FIG. 8 has a steeper slope than the slope of the corresponding portion 104 of the ramp device of FIG. 1. However, the slope of the right hand portion of the wheel tread path 204 of FIG. 8 is less than the slope of the corresponding portion of wheel tread path 104 of FIG. 1 (dashed line 104'' of FIG. 8), thus allowing the car wheel to accelerate more smoothly than in the corresponding wheel tread surface of FIG. 1 whereby the increased velocity of the wheel can more easily and smoothly climb the left hand half of the wheel tread curve portion 240 to reach the top surface 106'' of the ramp device of FIG. 8.

The remainder of the ramp device of FIG. 8 is substantially the same as the ramp device of FIG. 1.

Figure 9:
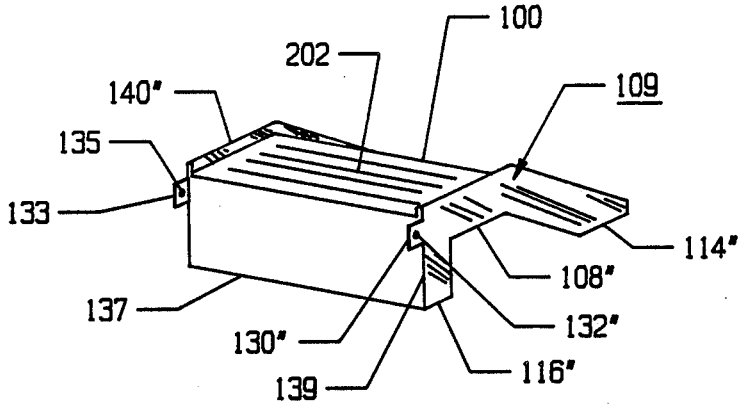
FIGS. 9, 10 and 11 show the three sections of the ramp device separately and in perspective.

Referring now specifically to FIG. 9 the section 109 includes the ramp surface 100'' and a portion of the horizontal surface 202. Section 109 also includes two tabs 130'' and 133 with holes such as hole 132'' therein through which a bolt passes. Bolts are passed through the holes 132'' of FIG. 109 and then, through hole 119 of section 111 in FIG. 10. There are two holes, such as holes 119, in section 111 of FIG. 10 with the other hole being aligned with the hole 119 and on the other side of the section 111. The bolt then passes through the hole 135 of the tab 133 of section 109 of FIG. 9, thus securing the section 109 of FIG. 9 to section 111 of FIG. 10.

Figure 10:
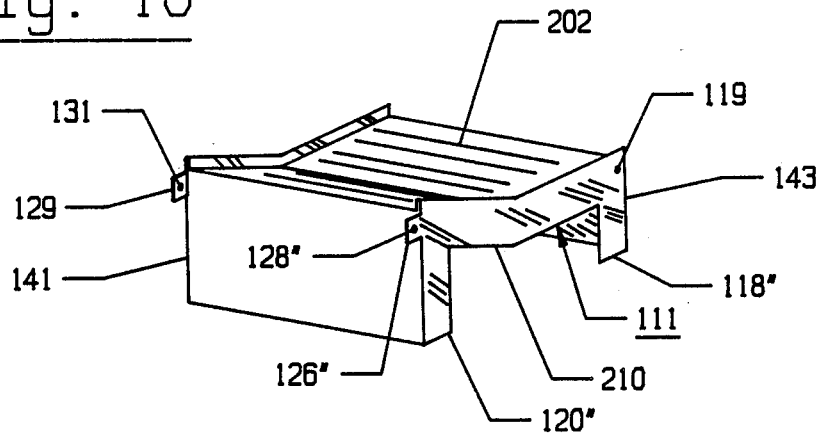
Figure 11:
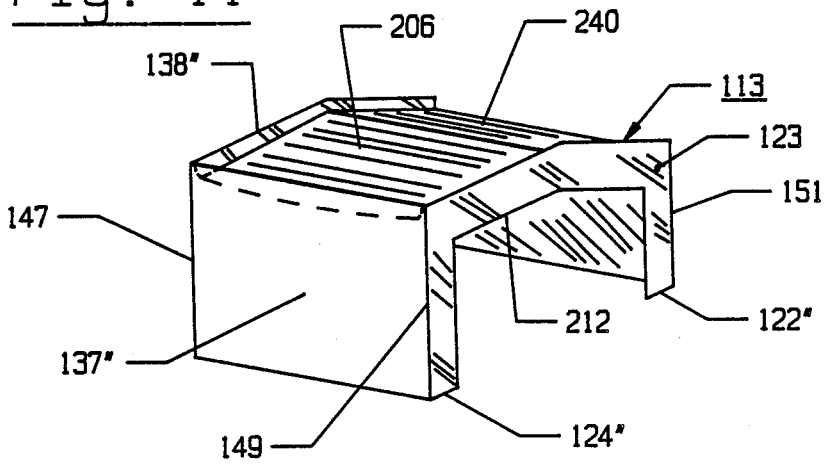

In a similar manner section 111 of FIG. 10 is secured to section 113 of FIG. 11, which is the topmost section of the ramp device. More specifically, a bolt is passed through the hole 128'' of section 111 of FIG. 10, and then through a pair of holes such as hole 123 located in corresponding positions on opposite sides of section 113 of FIG. 11. Finally the bolt is then passed through the hole 131 of tab 129 of section 111 of FIG. 10 to secure section 111 of FIG. 10 to section 113 of FIG. 11.

It can be seen that each of the sections 109, 111 and 113 of FIGS. 9, 10 and 11 can be formed basically from one sheet of stamped metal. For example, in FIG. 9 the lip 140'' exists on both sides of the surface 202 and extends down the entrance ramp surface 100, all of which can be formed from one sheet or metal. The end piece of 137 of section 109 of FIG. 9 can also be formed from that same sheet of metal assuming that the original pattern is cut to permit the folding of the metal to form the element 109 of FIG. 9. Certain of the seams, such as seam 139, are then welded together to complete the structure 109 of FIG. 9 into a strong, integrated and unitary structure.

Similarly, the section 111 of FIG. 10 can be formed from one properly cut sheet of metal with seams such as seam 141 being welded as well as seams such as seam 143, to form an integrated unitary structure of a strength great enough to support an automobile.

The final section 113 of FIG. 11 can also be formed in the manner described in connection with the formation of the elements 109 and 111 of FIGS. 9 and 10 with welding being required at certain seams such as the juncture or joints 147, 149 and 151.

Figure 12:
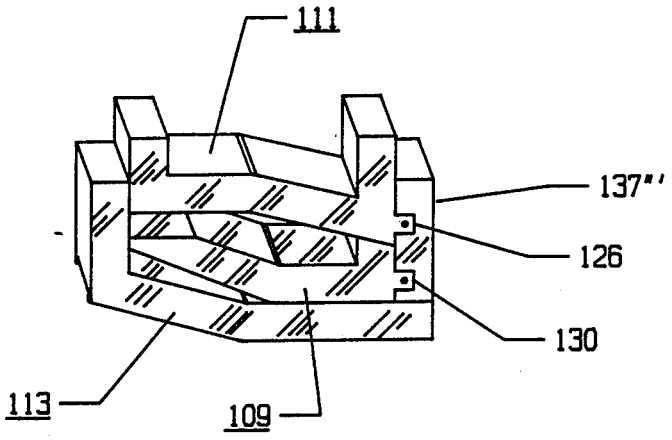
FIG. 12 illustrates how the three sections of the ramp device can be disassembled and nested for storage and transport purposes.

Referring now to FIG. 12 there is illustrated the manner in which the three sections 109, 111 and 113 can be stacked together to form a compact arrangement for storage when the ramp device is not in use.

It is to be understood that the forms of the invention shown and described herein are but preferred embodiments thereof and that various changes and modifications can be made therein by one of ordinary skill in the art without departing from the spirit or scope of the appended claims.

I claim:

1. A two level automobile wheel elevating device for sports type automobiles whose front end hood section extends farther away from the front wheels and is lower slung than the corresponding distances of more conventional family cars and whose bumper assembly is lower slung than the front end section hood section of said sports type automobiles; and comprising:

a wheel tread surface having a predetermined contour; and substantially parallel sidewall sections positioned on both sides of said wheel tread surface and extending above said wheel tread surface, and with the top perimeters of said parallel sidewall sections being secured to and separated by said wheel tread surface;

said wheel tread surface comprising a first wheel tread segment comprising a first rising wheel tread entrance ramp segment, a second wheel tread segment comprising a first horizontal wheel tread segment whose corresponding sidewall section at any point therealong has a height from ground level which is less than the height from ground level at any point on the bumper assembly of said sports type automobiles, a third wheel tread segment comprising a second rising wheel tread ramp segment, and a fourth wheel tread segment comprising a second substantially horizontal wheel tread surface segment whose highest level is always below the lowest level of said front end hood section;

said first, second, third, and fourth wheel tread segments connected together in the order listed to form a rising wheel tread surface having said predetermined contour;

said second and third wheel tread segments together having not more than one discontinuity in the path of the wheel tread surface between the top of said first rising wheel entrance ramp segment and the entrance onto the fourth wheel tread segment;

said first wheel tread entrance ramp segment rising from a first point on said ground level to said first horizontal wheel tread segment which in turn extends to a second point whose distance from said first point is not less than the distance from the dead center bottom of the front wheel to the front portion of the bumper assembly and with said first wheel tread entrance ramp having a rising elevation slope sufficient to raise all points of said bumper assembly a predetermined distance above the highest level of the top perimeter of said sidewall sections of any segment of said two level automobile wheel elevating device as said automobile wheel is rolled onto said two level automobile wheel elevating device;

said second rising wheel tread ramp segment beginning at the end of said first horizontal wheel tread surface segment and rising in a predetermined pattern to said second substantially horizontal wheel tread segment along a predetermined path which constantly maintains not less than a predetermined minimum distance between said nose and bumper assemblies and said top perimeter of said sidewalls; and a chock-like wheel stop element formed at the end of the fourth substantially horizontal wheel tread segment to prevent the automobile wheel from rolling off the end of said second substantially horizontal wheel tread segment of ground level.

2. A two level automobile wheel elevating device as in claim 1 in which said second wheel tread ramp segment comprises a gently upwardly rising curve contour to form a smooth, continuously rising path for the automobile wheel as it passes from said second horizontal wheel tread segment to said second horizontal wheel tread segment to avoid unnecessary acceleration of the automobile to climb sharp changes in slope, thereby minimizing chances of the automobile wheel overshooting the end of said two level wheel elevating device.

3. A two level automobile wheel elevating device as in claim 1 in which said second substantially horizontal wheel tread segment comprises a wheel chock stop element positioned securely at the end thereof opposite said first entrance ramp segment and extending above the said second substantially horizontal wheel tread surface segment to prevent the automobile wheel from overshooting said second horizontal wheel surface segment of said automobile elevating device.

4. A two level automobile wheel elevating device as in claim 1 in which said second substantially horizontal wheel tread segment is formed to be slightly concave to provide a resting place for the elevated wheel of the automobile.

5. A two level automobile wheel elevating device as in claim 1 and further comprising means for physically connecting and disconnecting said automobile wheel elevating device into at least three sections at points enabling compact stacking of said disconnected sections of said automobile wheel elevating device when not in use.

6. A two level car wheel elevating device comprising:

first, second, third, and fourth wheel tread segments joined together to form a continuous wheel tread surface over which the car wheel can travel from ground level to the fourth wheel tread segment with not more than three discontinuities for elevating any of the wheels of a car which has a greater than usual front end extended nose whose lowest vertical distance T from ground level is $\geqq(I+K)$ and a greater than normal low slung bumper assembly whose lowest vertical distance from ground level is $\geqq(K+F)$ and which extends horizontally from the dead bottom center of the wheel to be elevated a distance $<(L+N)$, where I is the maximum height of the sidewall of said fourth wheel tread segment, K is the minimum distance of any portion of the extended nose or the low slung bumper assembly from any point on the two level wheel elevating device when the car is in any position on said two level wheel elevating device, where F is the minimum distance from ground level to the top of the sidewall of said second wheel tread segment, where N is the horizontal distance of the vertical projection of said first wheel tread segment upon ground level, and where L is the maximum horizontal length of said second wheel tread segment;

a pair of vertically positioned sidewalls positioned on either side of said wheel tread surface and firmly secured to said wheel tread surface to support the weight of said front car wheel on said wheel tread surface;

the top perimeters of said sidewalls extending above said wheel tread surface a substantially constant distance R to reduce the chance of the wheel of said car from rolling off the side of said wheel elevating device, where R is the substantially constant vertical distance of the extension of the sidewalls above the adjacent wheel tread segments;

said first wheel tread segment comprising an entrance ramp extending from ground level to said second wheel tread segment a distance G above ground level and whose horizontal projection length is N, and where G is less than the distance from the lowest point on the bottom of said low slung bumper assembly to ground level;

said second wheel tread segment comprising a first horizontal level and extending from the top of said entrance ramp horizontally a distance L at an elevation G above ground level;

said third wheel tread segment comprising a second ramp segment extending a vertically projected horizontal distance M from the exit end of said second wheel tread segment to the entrance of said fourth wheel tread segment, which is an approximate distance H above ground level, and where $$\frac{M}{I-F} < \frac{N}{F}, (F - G = R), \text{ and } (H + K) < T;$$

said fourth wheel tread segment comprising a second substantially horizontal segment which is the highest level of the wheel elevating device and the level upon which the car wheel finally comes to rest; and a chock-like wheel stop element formed at the end of the fourth substantially horizontal wheel tread segment to prevent the automobile wheel from rolling off the end of said fourth substantially horizontal wheel tread segment to ground level.

7. A two level car wheel elevating device as in claim 6 in which said second wheel tread segment and said second ramp segment together comprise a gently upwardly rising and continuously curvilinear contour to form a smooth, continuously rising path for the car wheel as it passes from said first wheel tread segment to said fourth wheel tread segment to avoid the unnecessary acceleration of the car normally required to climb sharp changes or discontinuities in slope, thereby minimizing chances of over-shooting the wheel over the end of the wheel elevating device.

8. A two level car wheel elevating device as in claim 6 in which said fourth wheel tread segment comprises a wheel chock stop element positioned securely at the end thereof opposite said entrance ramp and extending above the said fourth wheel tread segment to prevent the car wheel from overshooting said fourth wheel tread segment of said two level car wheel elevating device.

9. A two level car wheel elevating device as in claim 6 in which said fourth top level wheel tread segment is slightly concave in shape to provide a resting place for the front wheel of said car.

10. A two level car wheel elevating device as in claim 6 and further comprising means for physically connecting and disconnecting said car wheel elevating device into three or more sections at points enabling compact stacking and storing of said disconnected sections of said car wheel elevating device when not in use.

11. A two level car wheel elevating ramp for elevating a wheel of a sports car and the like having a lesser ground level to bumper assembly distance (F+K) and a longer distance Y measured from the bottom dead center of the front wheel to the front end of the bumper assembly than most conventional family type cars, where F is the minimum distance from ground level to the top of the sidewall of said second wheel tread segment and is less than the distance from the lowest point on the bottom of said bumper assembly to ground level, and where K is the minimum distance of any portion of the extended portion of the extended nose of the car or the low slung bumper assembly from any point on the two level wheel elevating device when the car is in any position on said two level wheel elevating device and comprising;

a wheel tread surface having an overall side view contour comprising in the order set forth below;

a first wheel tread surface entrance ramp segment rising from ground level to a second level a distance G above ground level and whose vertical projection onto ground level has a horizontal distance N, where G is less than the minimum vertical distance of the lowest point on the bottom of said bumper assembly above ground level;

a second wheel tread surface segment extending substantially horizontally for at least a portion thereof from the top of said first wheel surface ramp a distance not greater than L and at a vertical distance G from ground level over said distance L; and a topmost substantially horizontal level segment;

a second wheel surface ramp segment rising from said second wheel surface segment to said topmost substantially horizontal level which is approximately a distance H above ground level;

the distance L+N being at least equal to a distance Y and the bumper assembly being at least a distance K above the wheel elevating ramp at any position of the car as it begins to climb the car wheel elevating ramp until and when it reaches the topmost substantially horizontal level segment of said car wheel elevating ramp, where Y is the distance between the dead bottom center of the wheel tread when said wheel is at the entrance to said first wheel tread segment and the front end of said bumper assembly;

the angle of slope of said first wheel surface ramp segment at any point thereon upon which the bottom dead center of said front wheel rests being greater than the angle of slope of said second wheel surface ramp segment at the point of intersection of the nearest point of said bumper assembly with said second wheel surface ramp segment along a vertical plane parallel to the axis of the car wheel; and a clock like wheel stop formed at the end of the topmost substantially horizontal level segment to prevent the automobile wheel from rolling off the end of said topmost substantially horizontal level segment to ground level.

12. A two level car wheel elevating ramp as in claim 11 in which at least a portion of said second wheel surface segment and said second wheel surface ramp together comprise a continuously rising curve without discontinuities to form a smooth, continuously rising path for the car wheel as it passes from the top of said first wheel surface ramp segment to said topmost substantially horizontal level segment to avoid unnecessary acceleration of the car to climb sharp changes in slope, thereby minimizing chances of overshooting the car wheel over the end of said wheel elevating ramp.

13. A two level car wheel elevating ramp as in claim 11 in which said topmost third substantially horizontal level segment comprises a wheel chock stop element positioned securely at the end thereof opposite the entrance ramp segment and extending above the said topmost substantially horizontal level segment to prevent the car wheel from overshooting the topmost third substantially horizontal level segment of said car wheel elevating ramp.

14. A two level car wheel elevating ramp in claim 11 in which said topmost substantially horizontal level segment is slightly concave to provide a resting place for said car front wheel.

15. A two level automobile wheel elevating ramp as in claim 11 and further comprising means for physically connecting and disconnecting said car wheel elevating device into at least three sections at points to enable compact stacking of said disconnected sections of said car wheel elevating ramp when not in use.

16. A two level car wheel elevating device for cars having bumper assemblies positioned closer to horizontal ground level and noses extending farther from the front wheel of the car than the bumper assemblies and noses of conventional family cars and comprising:

first, second, third, and fourth segments which, in the order listed, comprise the wheel tread surface segments of said wheel elevating device nd which are connectably and disconnectably separable into two or more sections at selectable points as will provide suitable stacking for storage and transport when separated;

said first segment forming a rising entrance ramp to elevate the car wheel a distance G from horizontal ground level to said second segment;

said second segment comprising a first non-discontinuous level elevated above ground level a first predetermined distance not less than G and extending a distance L, where L plus the horizontal distance N component of said rising entrance ramp is greater than the distance between a first vertical line extending from the bottom dead center of the car wheel to be elevated and a second vertical line extending from the point on the bumper or nose assemblies of the car closest to the car wheel elevating device measured along a horizontal line between the first and second vertical lines when the dead bottom center of the wheel to be elevated is at the entrance to said first segment;

said third segment comprising a second rising ramp rising to said fourth segment with an average slope less than the average slope of said entrance ramp and defining a wheel tread surface segment of a predetermined contour to maintain the distance between any point on the car wheel elevating device and the nearest point on the bumper or nose assemblies of the car not less than a predetermined distance K as the car wheel progresses along said third segment;

said fourth segment comprising a topmost substantially horizontal surface with a tire chock stop formed on the end thereof to prevent the car wheel from rolling off the end of said fourth segment;

each of said first, second, third, and fourth segments forming the car wheel elevating device further comprising a pair of parallel, vertical side walls which support said wheel tread surface segments therebetween;

said side walls extending above said wheel supporting surface a predetermined distance less than K to help maintain the car wheel between the side walls of said segments and to act as a guide for the car wheel elevating device.

17. A car wheel elevating device as in claim 16 in which said second ramp comprising a gently upwardly rising curve contour to form a smooth, continuously rising path for the car wheel as it passs from said first horizontal level to said fourth wheel tread surface segment to avoid unnecessary acceleration of the car normally required to climb sharp changes in slope, thereby minimizing chances of the car wheel overshooting the end of said car wheel elevating device.

18. A two level car wheel elevating device as in claim 16 in which said fourth segment comprises a wheel chock stop element positioned securely at the end thereof opposite the entrance ramp and extending above said fourth segment to prevent the car wheel from overshooting said fourth segment of said car wheel elevating device.

19. A two level automobile wheel elevating device as in claim 16 in which said fourth segment is slightly concave to provide a resting place for the elevated wheel of the car.

20. A two level car wheel elevating device as in claim 16 and further comprising means for physically connecting and disconnecting said car wheel elevating device into at least three selectable sections at points to enable compact stacking of said disconnected sections of said car wheel elevating device when not in use.

* * * * *